US010322579B2

(12) United States Patent
Maier et al.

(10) Patent No.: US 10,322,579 B2
(45) Date of Patent: Jun. 18, 2019

(54) INKJET PRINTING SYSTEM AND METHOD TO REDUCE SYSTEM-DEPENDENT STREAKING

(71) Applicant: Océ Holding B.V., Venlo (NL)

(72) Inventors: Christian Maier, Feldkirchen-Westerham (DE); Wolfgang Hettler, Feldkirchen-Westerham (DE); Christoph Stadler, Dachau (DE); Felix Wehr, Munich (DE)

(73) Assignee: Océ Holding B.V., Venlo (NL)

( * ) Notice: Subject to any disclaimer, the term of this patent is extended or adjusted under 35 U.S.C. 154(b) by 0 days.

(21) Appl. No.: 15/806,886

(22) Filed: Nov. 8, 2017

(65) Prior Publication Data

US 2018/0126729 A1 May 10, 2018

(30) Foreign Application Priority Data

Nov. 10, 2016 (DE) ..... 10 2016 121 497

(51) Int. Cl.
*B41J 2/045* (2006.01)

(52) U.S. Cl.
CPC ..... *B41J 2/04588* (2013.01); *B41J 2/04525* (2013.01); *B41J 2/04581* (2013.01); *B41J 2/04593* (2013.01); *B41J 2/04596* (2013.01)

(58) Field of Classification Search
CPC ..... B41J 2/04588; B41J 2/04581
See application file for complete search history.

(56) References Cited

U.S. PATENT DOCUMENTS

2010/0201726 A1 8/2010 Kondo et al.

FOREIGN PATENT DOCUMENTS

DE 102013107942 A1 1/2015
JP 2012111095 A * 6/2012

OTHER PUBLICATIONS

IP.com search (Year: 2018).*
Machine Translation of Liquid Jet Apparatus and Control Method (JP 2012-111095 A), Fukuda, Toshiya, Jun. 14, 2012, Paragraphs 0016, 0019-0020, 0025-0029, see Figs. 1-2 and 4 (Year: 2012).*
IP.com search (Year: 2019).*
German office action dated Aug. 11, 2017 for German Application No. 102016121497.3.

* cited by examiner

*Primary Examiner* — Lisa Solomon
(74) *Attorney, Agent, or Firm* — Schiff Hardin LLP

(57) ABSTRACT

In a printing system and a corresponding method, different nozzles of a print head can be activated to eject a nominal ink quantity with different ejection pulses to at least partially compensate for non-uniformities between the different nozzles due to crosstalk. The compensation can reduce system-dependent streaking of the print image.

17 Claims, 2 Drawing Sheets

INKJET PRINTING SYSTEM AND METHOD TO REDUCE SYSTEM-DEPENDENT STREAKING

CROSS REFERENCE TO RELATED APPLICATIONS

This patent application claims priority to German Patent Application No. 102016121497.3, filed Nov. 10, 2016, which is incorporated herein by reference in its entirety.

BACKGROUND

The present disclosure relates to an inkjet printing system for reducing system-dependent streaking, and a corresponding method.

Inkjet printing systems may be used for printing to recording media (paper, for example). An inkjet printing system may comprise one or more print bars having respectively one or more print heads. Each print bar may thereby be used for the printing of a specific color. The recording medium may be directed in a transport direction past the one or more print bars in order to print a print image onto the recording medium row by row.

Each nozzle of a print head is configured to fire or eject ink droplets onto the recording medium. A nozzle thereby typically comprises a pressure chamber in which pressure is built up in order to generate an ink droplet. The pressure chambers of the individual nozzles of a print head may be connected with a common ink reservoir via one or more ink supply channels. Given a print head with a relatively high density of nozzles, interactions may therefore occur between adjacent nozzles of a print head. The print quality of an inkjet printing system may thereby be negatively affected. In particular, a (periodic) streaking of a print image (what is known as the corduroy effect) may occur due to interactions.

The German publication DE 10 2013 107942 A1 describes a method for compensation of streaking in which correction values for the nozzles of a print head are taken into account within the scope of a rastering process. However, the consideration of correction values in a rastering process is typically connected with relatively high computation costs.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
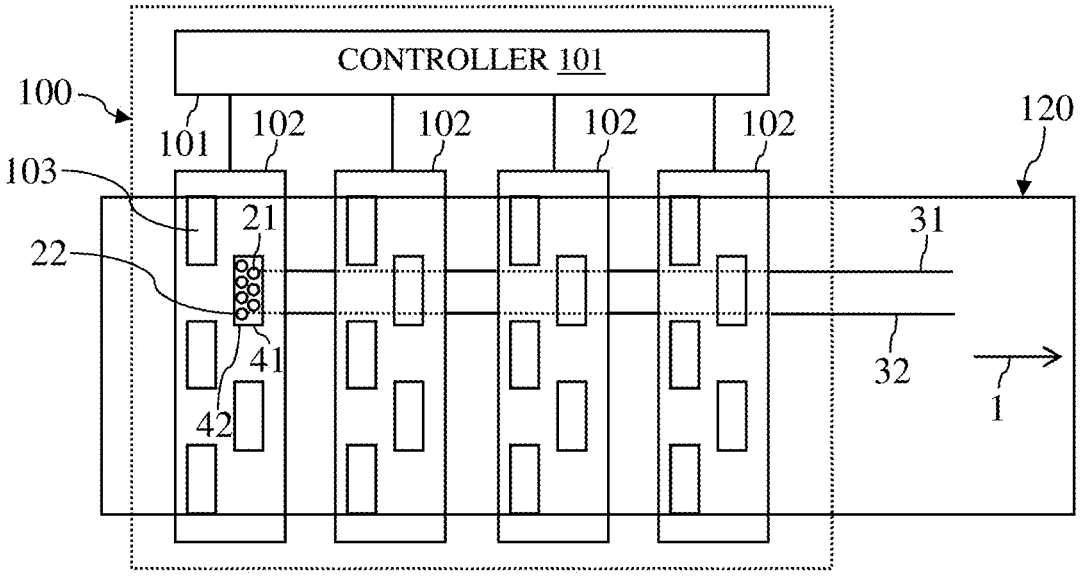
FIG. 1 illustrates an inkjet printing system according to an exemplary embodiment of the present disclosure.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide an inkjet printing system and a method with which a periodic streaking of a print image may be reduced in a resource-efficient manner.

According to an aspect of the disclosure, an inkjet printing system is described that comprises a print head having a first nozzle for printing image points of a first column of a print image, and having a second nozzle for printing image points of a second column of a print image. In an exemplary embodiment, the printing system may include at least one transporter that is configured to move the recording medium and the print head relative to one another in a transport device so that rows of the print image may be printed bit by bit by the print head, wherein the first column and the second column of the print image travel in a transport direction. Moreover, in an exemplary embodiment, the printing system includes a controller that is configured to activate the first nozzle to print a print image with a nominal quantity of ink with a first ejection pulse. The controller can furthermore be configured to activate the second nozzle to print a print image with the nominal quantity of ink with a second ejection pulse, wherein the first ejection pulse and the second ejection pulse are different.

According to an aspect of the disclosure, a method is described to reduce a system-dependent streaking of a print image printed by an inkjet printing system. In an exemplary embodiment, the printing system includes a print head having a first nozzle to print image points of a first column of the print image and a print head having a second nozzle to print image points of a second column of the print image. A recording medium and the print head may thereby be moved relative to one another in a transport direction to print sequential rows of the print image. The first column and the second column may then travel in the transport direction. In an exemplary embodiment, the method includes the determination that the first nozzle and the second nozzle for the printing of image points should respectively eject ink with a nominal ink quantity in a specific row. Moreover, the method can include the activation of the first nozzle for printing a print image of the determined row with a first ejection pulse, and the activation of the second nozzle for printing a print image of the determined row with a second ejection pulse, wherein the first ejection pulse and the second ejection pulse are different.

Exemplary embodiments described herein relate to the resource-efficient compensation of streaking effects—what is known as the corduroy effect—in inkjet printing systems. FIG. 1 shows a block diagram of an example of an inkjet printing system 100 according to an exemplary embodiment. In an exemplary embodiment, the printing system 100 depicted in FIG. 1 is designed for a continuous printing (i.e. for printing on a recording medium 120 that is "continuous" or in the form of a web (also designated as "continuous feed")), but is not limited thereto. The recording medium 120 may be produced from paper, paperboard, cardboard, metal, plastic, textiles, and/or other materials that are suitable and can be printed to. In an exemplary embodiment, the recording medium 120 can be taken off a roll (the take-off) and then supplied to the print group of the printing system 100. A print image is applied onto the recording medium 120 by the print group, and the printed recording medium 120 is taken up again on and additional roll (the take-up), possibly after fixing/drying of the print image. Alternatively, the printed recording medium 120 may be cut into sheets or pages by a cutting device. In FIG. 1, the transport direction 1 of the recording medium 120 is represented by an arrow 1. The embodiments of the present disclosure are also applicable to a printing system for printing to recording media 120 in the form of sheets or pages.

With continued reference to FIG. 1, the print group of the printing system 100 can include, for example, four print bars 102, but is not limited thereto. The different print bars 102 may be used for printing with inks of different colors (for example black, cyan, magenta and/or yellow) and/or different properties/characteristics. The print group may further include additional print bars 102 for printing with additional colors or additional inks (for example MICR ink). The printer group may include less than four print bars in other aspects.

In an exemplary embodiment, one or more print heads 103 (e.g. each print head 103) of the print bar 120 can include multiple nozzles 21, 22, wherein each nozzle 21, 22 is configured to fire or push ink droplets onto the recording medium 120. In an exemplary embodiment, a print head 103 may include 2558 effectively used nozzles 21, 22, for example, which nozzles 21, 22 are arranged along one or more rows 41, 42 transversal to the transport direction 1 of the recording medium 120. The number of nozzles, print groups, and print bars are not limited to the exemplary quantities described herein. In an exemplary embodiment, the nozzles 21, 22 in the individual rows 41, 42 may be arranged offset from one another. A row on the recording medium 120 may respectively be printed transversal to the transport direction 1 by means of the nozzles 21, 22 of a print head 103. An increased image point resolution transversal to the transport direction 1 may be provided via the use of L rows having (transversally offset) nozzles (L>1, for example L=32). In total, for example, K=12790 droplets may thus be fired by a print bar 102, depicted in FIG. 1, along a row onto the recording medium 120 (for example for a print width of approximately 54 cm at 600 dpi (dots per inch)).

In an exemplary embodiment, the printing system 100 additionally includes a controller 101 (e.g. an activation hardware, processor, control circuit, etc.) that is configured to activate the actuators of the individual nozzles of the individual print heads 103 to apply a print image onto the recording medium 120 based on print data. In an exemplary embodiment, the controller 101 includes processor circuitry that is configured to perform one or more operations and/or functions of the controller 101, including, for example, activating the actuators based on the print data.

In an exemplary embodiment, the printing system 100 includes at least one print bar 102 having K nozzles 21, 22 that may be activated with a specific line clock in order to print a line (transversal to the transport direction of the recording medium 120) with K pixels or K columns onto the recording medium 120. Due to the arrangement in L rows, the nozzles 21, 22 of a print head 103 are typically activated with a (fixed) time offset relative to one another in order to print a row. In the presented example, the nozzles 21, 22 are immovable or installed fixed in the printing system 100, and the recording medium 120 is directed past the stationary nozzles 21, 22 with a defined transport velocity. A specific nozzle 21, 22 thus prints a corresponding specific column 31, 32 (in the transport direction 1) onto the recording medium 120. In other words, there may be a one-to-one association between 21, 22 and columns 31, 32 of a print image, such that the image points of a first column 31 of the print image are printed exclusively by a first nozzle 21 and the image points of a second column 32 of the print image are printed exclusively by a different, second nozzle 22. Each nozzle 21, 22 of a print head 103 may thus be associated with precisely one column 31, 32, and each column 31, 32 may be associated with precisely one nozzle 21, 22 of a print head 103. A maximum of one ink ejection thus takes place via a specific nozzle 21, 22 per row of the print image.

Figure 2:
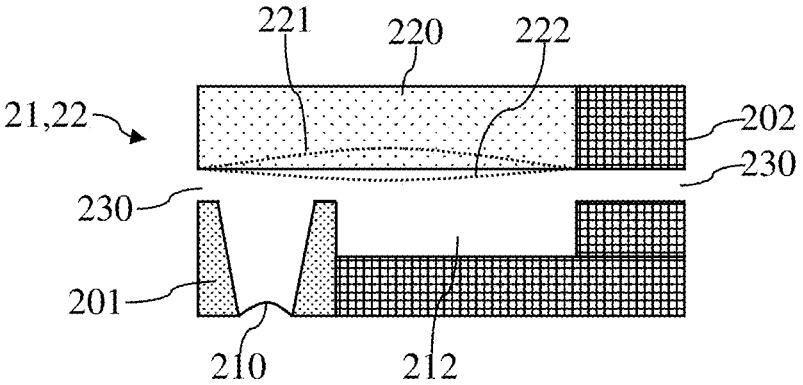
FIG. 2 illustrates a nozzle structure according to an exemplary embodiment of the present disclosure.

FIG. 2 shows an example of a structure of a nozzle 21, 22 of a print head 103 according to an exemplary embodiment. In an exemplary embodiment, the nozzle 21, 22 includes walls 202 which, together with an actuator 220, form a receptacle or a pressure chamber 212 to accommodate ink. The nozzle 21,22 can be configured to fire one or more ink droplets onto the recording medium 120 via a nozzle opening 201 of the nozzle 21, 22. The ink forms what is known as a meniscus 210 at the nozzle opening 201. Furthermore, the nozzle 21, 22 includes an actuator 220 (for example a piezoelectric element) that is configured to vary the volume of the pressure chamber 212 to take up ink, or to vary the pressure in the pressure chamber 212 of the nozzle 21, 22. In particular, the volume of the pressure chamber 212 may be reduced, and the pressure in the pressure chamber 212 increased, by the actuator 220 as a result of a deflection 222. An ink droplet is thus pushed from the nozzle 21, 22 via the nozzle opening 201. FIG. 2 shows a corresponding deflection 222 of the actuator 220 (dotted lines). Moreover, the volume of the pressure chamber 212 may be increased by the actuator 220 (see deflection 221) in order to draw new ink into the pressure chamber 212 via an ink supply channel 230.

Via a deflection 221, 222 of the actuator 220, the ink within the nozzle 21, 22 may thus be moved and the chamber 212 may be placed under pressure. A specific movement of the actuator 220 thereby produces a corresponding specific movement of the ink. The specific movement of the actuator 220 is typically produced by a corresponding specific waveform or a corresponding specific pulse of an activation signal of the actuator 220. In particular, via a fire pulse (also designated as an ejection pulse) to activate the actuator 220, it may be produced that the nozzle 21, 22 ejects an ink droplet via the nozzle opening 201. In particular, ink droplets having different droplet size or having different ink quantities (for example 5 pl, 7 pl or 12 pl) may thus be ejected. In an exemplary embodiment, via a prefire pulse (also designated as a pre-ejection pulse) to activate the actuator 220, the nozzle 21, 22 can produce a movement of the ink and an oscillation of the meniscus 210 while also preventing an ink droplet from being ejected via the nozzle opening 201.

In an exemplary embodiment, the different nozzles 21, 22 of a print head 103 or of a print head segment are partially connected with one another, and with an ink reservoir, via one or more ink supply channels 230. Ink may be drawn into the pressure chamber 212 of a nozzle 21, 22 via the ink supply channels 230 (e.g. when the actuator 220 is deflected as shown by the deflection 221). The nozzles 21, 22 of a print head 103 (or of a print head segment) may thereby mutually, indirectly affect one another via the one or more ink supply channels 230. This may lead to negative effects on the print quality of an inkjet printing system 100.

Figure 3:
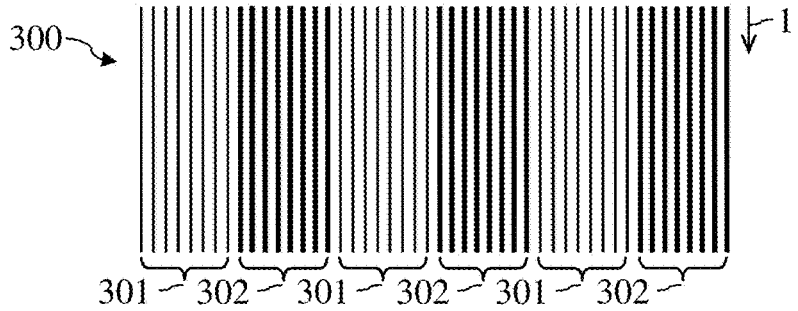
FIG. 3 illustrates an example print image having a corduroy effect according to an exemplary embodiment of the present disclosure.

The mutual influencing of the nozzles 21, 22 (also designated as crosstalk) of a print head 103 may in particular lead to a corduroy effect upon printing a completely inked area, i.e. to a (possibly periodic) streaking with visible streaks or bars that travel in the transport direction 1. FIG. 3 shows an example of a print image 300 with groups 301, 302 of columns having different greyscale values. The transport direction 1 of the recording medium 120 is represented by an arrow. First groups 301 of columns have a relatively low greyscale value, and second groups 302 of columns have a relatively high greyscale value. The first groups 301 and the second groups 302 thereby alternate so that a periodic streak pattern appears.

Turning to FIG. 3, the different groups 301, 302 of columns are printed by different groups of nozzles 21, 22 of a print head 103. In the example presented in FIG. 3, all nozzles 21, 22 of the print head 103 are activated with a specific standard pulse for a specific nominal ink quantity. Due to interactions between the nozzles 21, 22, a first group 301 of nozzles ejects less ink than a second group 302 of nozzles, such that the streak pattern shown in FIG. 3 results.

Figure 4:
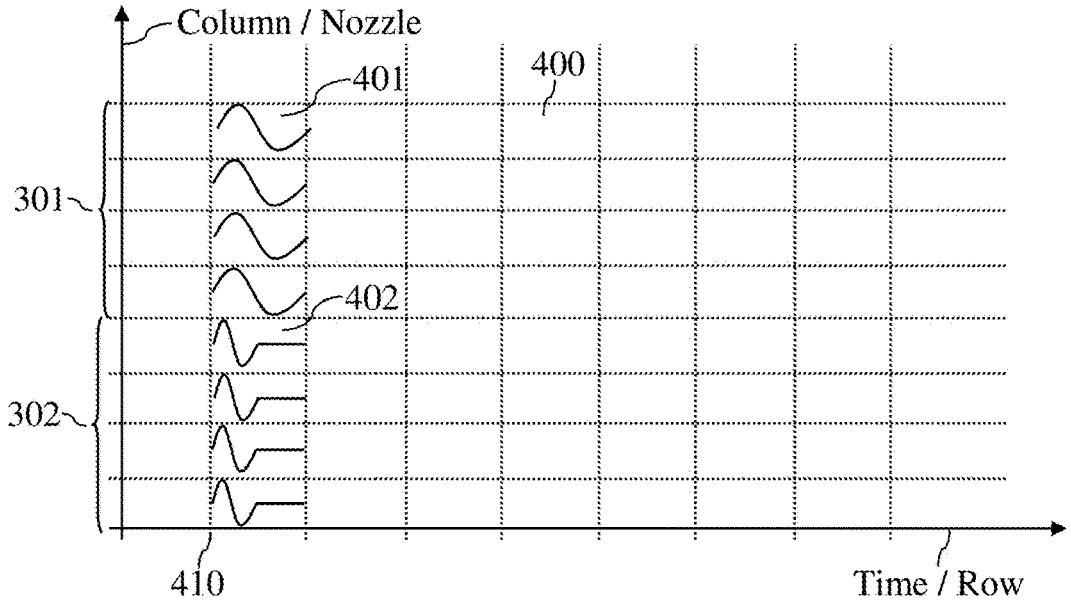
FIG. 4 illustrates a plot of ejection pulses for the activation of different nozzles of a print head according to an exemplary embodiment of the present disclosure.

In an exemplary embodiment, different ejection pulses may be used for the different groups 301, 302 of nozzles 21, 22 to (at least partially) compensate for a streak pattern. In particular, a first ejection pulse for the specific nominal ink quantity may be used for the first group 301 of nozzles 21, and a second ejection pulse for the specific nominal ink quantity may be used for the second group 302 of nozzles 22. FIG. 4 shows an example of a first ejection pulse 401 and an example of a second ejection pulse 402. The first ejection pulse 401 typically produces a stronger deflection of the actuator 220 of a nozzle 21, 22 than the second ejection pulse 402. In particular, the first ejection pulse 401 may be amplified, starting from the standard pulse to increase the ejected ink quantity. On the other hand, the second ejection pulse 402 may be weakened, starting from the standard pulse, in order to reduce the ejected ink quantity. The greyscale value of the image points 400 printed by the first group 301 of nozzles 21 may be increased, and/or the greyscale value of the image points 400 printed by the second group 302 of nozzles 22 may be reduced. As a result of this, a periodic streaking of print images 300 may be reduced.

The nozzles 21, 22 of a print head 103 may, if applicable, be activated to eject M different nominal ink quantities to generate M image points 400 of different sizes, wherein M is a whole number with M>1, for example M=3. For each nominal ink quantity, different ejection pulses 401, 402 may be provided for the different groups 301, 302 of nozzles 21, 22. In particular, M first ejection pulses 401 may be provided for the first group 301 and M second ejection pulses 402 may be provided for the second group 302.

The respective pairs of ejection pulses 401, 402 may be determined in advance on the basis of full-area test print images 300. For example, a test print image 300 may initially be printed with a uniform standard pulse for a specific, nominal ink quantity. The first ejection pulse 401 may then be amplified by a factor relative to the standard pulse, and the second ejection pulse 401 may be attenuated by the factor relative to the standard pulse. A full-area test print image 300 may then be printed with the first ejection pulse 401 for the first group 301 of nozzles 21, and with the second ejection pulse 402 for the second group 302 of nozzles 22. The factor may then be iteratively adapted (in particular increased) until the periodic streaking has been completed compensated, or has at least been partially compensated (for example has been compensated by 50%). Pairs of ejection pulses 401, 402 may accordingly be determined for all M ink quantities.

In the operation of a printing system 100, the M pairs of ejection pulses 401, 402 may then be used to activate the different groups 301, 302 of nozzles 21, 22. For printing a print image 300, the print data typically show the nominal ink quantities to be ejected by the individual nozzles 21, 22 for each image point 400 of a row (for example as a 2-bit value for each image point 400). For each of the K nozzles 21, 22 of a print bar 102, the ink quantity of an ink droplet to be ejected may thus be determined to print a row of a print image 300 on the basis of the print data (for example value "0"≠no ink ejection, value "1"—first ink quantity, value "2"—second ink quantity, value "3"—third ink quantity). Depending on whether a nozzle 21, 22 belongs to the first group 301 or to the second group 302 of nozzles 21, 22, a first ejection pulse 401 or a second ejection pulse 402 may then be used in order to activate the nozzle 21, 22 for the printing of an image point 400 at a specific activation point in time 410. The periodic streaking of print data-based print images 300 may thus be reduced.

As discussed above, what is known as the corduroy effect may occur upon printing with inkjet printing systems 100. Due to the geometry and/or the design of a print head 103, a specific set 302 of nozzles 22 thereby prints darker and a specific set 301 of other nozzles 21 prints lighter. For example, groups 301, 302 of eight respective nozzles 21, 22 may alternately print lighter or darker. Synchronous and/or periodic streaking may thus occur, which can be expressed to varying degrees for different droplet sizes.

The periods of the streaking may be different for different types of print heads 103. In an exemplary embodiment, a fixed compensation of the streaking may be performed depending on the type of print head 103. For example, an ejection pulse 401, 402 (also designated as a waveform) that is adapted with regard to droplet volume may be used for the respective group 301, 302 of nozzles 21, 22. The light and/or dark regions of a test print image 300 may thus be at least partially adjusted to one another in order to at least partially reduce the corduroy effect.

In an exemplary embodiment, ejection pulses 401, 402 that vary depending on the nozzle are loaded in a non-volatile manner into a print head activator to reduce the corduroy effect. This is thereby enabled since the corduroy effect occurs repeatably and uniformly in full-area print images 300. If applicable, only a partial compensation of the corduroy effect may thereby be performed for a full-area test print image 300 (for example between 40% and 60%) in order to prevent a degradation of the print quality for print images that do not cover the entire area.

In an exemplary embodiment, printing system 100 may have three different standard pulses Fire1, Fire2 and Fire3 for three different nominal ink quantities, but is not limited thereto. Three first ejection pulses 401 Fire1+, Fire2+, Fire3+ may then be determined, as well as three second ejection pulses 402 Fire1−, Fire2− and Fire3−, wherein the waveforms with "+" are stronger than the waveforms with "−". During the printing of a print image 300, the first ejection pulses 401 Fire1+, Fire2+ and Fire3+ are used for the weaker nozzles 21 (from the first group 301), whereas the stronger nozzles 22 (from the second group 302) use the second ejection pulses 402 Fire1−, Fire2− and Fire3. The association of the ejection pulses 401, 402 with the various nozzles 21, 22 may be performed via an association table. The association table may be predefined in one or more embodiments. The ejection pulses may additionally or alternatively be dynamically adjusted in more or more embodiments. The dynamic adjustment may be based on, for example, an analyzed print image. The analysis may be performed using a sensor such as a camera or one or more other types of sensors as would be understood by one of ordinary skill in the art. The analysis may be performed by the controller 101 and/or a user of the printer.

Figure 5:
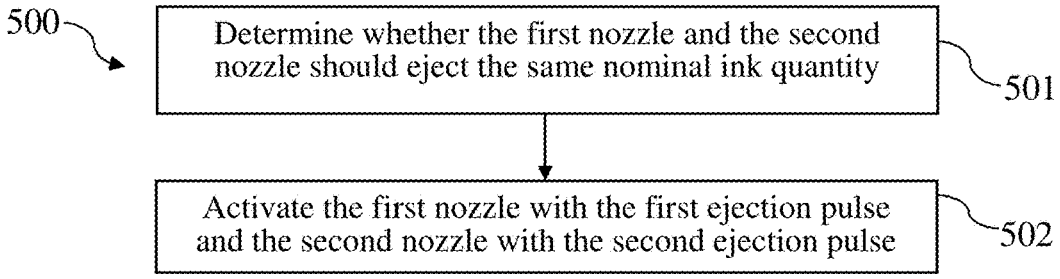
FIG. 5 illustrates a flowchart of a method for reducing a periodic streaking of a print image according to an exemplary embodiment of the present disclosure.

FIG. 5 shows a flowchart of a method 500 for reducing a system-dependent streaking of a print image 300 printed by an inkjet printing system 100 according to an exemplary embodiment. In an exemplary embodiment, the method 500 may be executed by a controller 101 of the printing system 100. The controller 101 can include a memory storing instructions and/or code, that when executed by the controller 101, controls the controller 101 to perform the method 500. Additionally or alternatively, the controller 101 can be configured to access an external memory to obtain instructions and/or code to control the controller 101 to perform the method 500.

The printing system 100 can include a print head 103 having a first nozzle 21 for printing image points 400 of a first column 31 of the print image 300, and having a second nozzle 22 for printing image points 400 of a second column 32 of the print image 300. The recording medium 120 for the print image 300 and the print head 103 may thereby be moved relative to one another in a transport direction 1 in order to print sequential rows of the print image 300. A row of the print image 300 thereby travels transversal to the transport direction 1, and a column 31, 32 of the print image 300 travels in the transport direction 1.

The system-dependent streaking of a print image 300 may in particular be caused by the crosstalk between the first nozzle 21 and the second nozzle 22 of the print head 103. The first nozzle 21 and the second nozzle 22 of the print head 103 are thereby typically substantially structurally identical (and therefore, in an isolated operation, might be activated with the same standard pulse in order to eject substantially the same nominal ink quantity). Furthermore, in the print head 103, a uniform ink is may be used for all nozzles 21, 22 of the print head 103. However, the crosstalk between the two nozzles 21, 22 may nevertheless lead to differences in the ejected ink quantity.

In an exemplary embodiment, the method 500 includes the determination 501 that the first nozzle 21 and the second nozzle 22 should respectively eject ink with a nominal ink quantity for the printing of image points 400 in a specific row. In other words, it may be determined that both the first nozzle 21 and the second nozzle 21 should eject the same nominal ink quantity (for example 5 pl, 7 pl or 12 pl) in the specific row. For example, this may be determined based on the print data for the print image 300 to be printed.

Moreover, the method 500 can include the activation 502 of the first nozzle 21 to print an image point 400 of the specific row with a first ejection pulse 401, and the activation of the second nozzle 22 to print an image point 400 of the specific row with a second ejection pulse 402. In an exemplary embodiment, the first ejection pulse 401 and the second ejection pulse 402 are different. A system-dependent streaking may be reduced in a resource-efficient manner via the different activation of the (structurally identical) first nozzle 21 and second nozzle 22 for the ejection of the same nominal ink quantity (of the same type of ink).

Accordingly, in the present disclosure, an inkjet printing system 100 is described, where the system 100 can include a print head 103 having a first nozzle 21 for printing of image points 400 of a first column 31 of a print image 300, and having a second nozzle 22 for printing of image points 400 of a second column 32 of a print image 300. The print image 300 may be printed by the print head 103 onto a recording medium 120. The printing system 100 may include at least one transporter that is configured to move the recording medium 120 and the print head 103 relative to one another in a transport direction 1 so that a sequence of rows of the print image 300 may be printed by the print head 103. The first column 31 and the second column 32 thereby travel in the transport direction 1. In an exemplary embodiment, the printing system 100 may be configured such that the image points 400 of the first column 31 are printed only by the first nozzle 21, and the image points 400 of the second column 32 are printed only by the second nozzle 22 (in a one-to-one relation).

In an exemplary embodiment, the printing system 100 includes a controller 101 that is configured to activate the first nozzle 21 for the printing of an image point 400 having a nominal ink quantity with a first ejection pulse 401. The controller 101 can be additionally configured to activate the second nozzle 22 to print an image point 400 having a nominal ink quantity with a second ejection pulse 402 that differs from the first ejection pulse 401.

In an exemplary embodiment, the printing system 100 may be configured to activate different (but structurally identical) nozzles 21, 22 of a print head 103 for the ejection of a specific nominal ink quantity (of a specific type of ink) with different ejection pulses 401, 402. In an exemplary embodiment, non-uniformities between the different nozzles 21, 22 may exist, and the non-uniformities can be due to crosstalk. In this example, the non-uniformities resulting from crosstalk may thus be at least partially compensated.

In an exemplary embodiment, the print head 103 can be configured such that a first column 31 of a test print image 300 (the first column 31 being printed by the first nozzle 21) is lighter than a second column 32 of the test print image 300 (the second column 32 being printed by the second nozzle 22) if the first nozzle 21 and the second nozzle 22 (for the printing of the image points 400 of the first column 31 or the second column 32) are activated with a standard pulse for the printing of image points 400 with the nominal ink quantity. The test print image 300 may, for example, include a solid color print of image points 400 with the nominal ink quantity in the first column 31 and in the second column 32. The activation (e.g. possibly simultaneous activation) of the first nozzle 21 and the second nozzle 22 with the same standard pulse may thus lead to lightness differences between the first column 31 and the second column 32. In particular, the standard pulse may have the effect that the first nozzle 21 ejects a smaller quantity of ink than the second nozzle 22. For example, the first nozzle 21 may eject an ink quantity that is smaller than the nominal ink quantity. On the other hand, the second nozzle 22 may eject an ink quantity that is greater than the nominal ink quantity. Such deviations of the actual ejected ink quantity from the nominal ink quantity may be produced by crosstalk between the first nozzle 21 and the second nozzle 22 (for example via a common ink supply channel 230).

In the aforementioned instance, the first ejection pulse 401 may be stronger than the second ejection pulse 402.

Alternatively or additionally, the first ejection pulse 401 may have more energy than the second ejection pulse 402. Alternatively or additionally, the first ejection pulse 401 may lead to a stronger deflection of the actuator 220 of a nozzle 21, 22 than the second ejection pulse 402. Furthermore, the first ejection pulse 401 may be stronger than the standard pulse. On the other hand, the standard pulse may be stronger than the second ejection pulse 402. Via the first ejection pulse 401 and the second ejection pulse 402, the differences in the ejected ink quantity of the nozzles 21, 22 of a print head 103 that are produced by the crosstalk may thus be at least partially compensated.

In particular, according to one or more embodiments, the first ejection pulse 401 and the second ejection pulse 402 may be such that the lightness difference between the first column 31 and the second column 32 of the test print image 300 is less. For example, the lightness difference can be at least half as great if the first nozzle 21 is activated with the first ejection pulse 401 and the second nozzle 22 is activated with the second ejection pulse 402 compared to if both the first nozzle 21 and the second nozzle 22 are activated with the standard pulse. Corduroy effects may thus be reliably reduced.

In an exemplary embodiment, the print head 103 may include a plurality of (possibly structurally identical) nozzles 21, 22 for printing a corresponding plurality of columns 31, 32 of a print image 300, wherein the plurality of nozzles 21, 22 alternately includes first groups 301 and second groups 302 of nozzles 21, 22. The print head 103 may be configured such that the first group 301 of nozzles 21 print lighter image points 400 in a test print image 300 (e.g. possibly on average) than the second group 302 of nozzles 22 if both the first group 301 and the second group 302 of nozzles 21, 22 are activated with the standard pulse.

The first groups 301 and/or the second groups 302 of nozzles 21, 22 may respectively include 4, 8 or more nozzles 21, 22. The number of nozzles 21, 22 in a group 301, 302 may thereby depend on a type of the print head 103. The first groups 301 and/or the second groups 302 typically respectively include multiple nozzles 21, 22 for printing the image points 400 of multiple directly adjacent columns 31, 32 of a print image 300. The formation of first groups 301 and/or of second groups 302 may thereby in particular be caused by a crosstalk between at least some of the nozzles 21, 22 of the print head 103. For example, multiple nozzles 21 of a nozzle row 41 of a print head 103 belong to a group 301. Nozzles 21, 22 from different nozzle rows 41, 42 of a print head 103 may then belong to different groups 301, 302. Alternatively, nozzles 21 (if applicable directly adjacent nozzles 21) from different nozzle rows 41, 42 of a print head 103 may belong to one group 301.

In an exemplary embodiment, the controller 101 may be configured to activate the first group 301 of nozzles 21 for the ejection of the nominal ink quantity with the first ejection pulse 401. On the other hand, the second group 302 of nozzles 22 for the ejection of the nominal ink quantity can be activated with the second ejection pulse 402. In an exemplary embodiment, the first ejection pulse 401 and the second ejection pulse 402 depend on the respective type of print head 103.

In an exemplary embodiment, the controller 101 can be configured to activate the first nozzle 21 for the printing of different image points 400 with M different nominal ink quantities with accordingly M different first ejection pulses 401. In an exemplary embodiment, M is a whole number, with M>1. On the other hand, the second nozzle 22 for printing different image points 400 with the M different nominal ink quantities are activated with accordingly M different second ejection pulses 402. In other words, M different first ejection pulses 401 and M different second ejection pulses 402 may be provided for the printing of M image points 400 of different sizes. Corduroy effects for different image point sizes may thus be reliably reduced.

In an exemplary embodiment, the controller 101 can be configured to determine print data for printing a row of the print image 300. For the first nozzle 21 and the second nozzle 22, the print data thereby indicate whether the respective nozzle 21, 22 should eject ink or not in the row for the printing of an image point 400. Furthermore, the print data may indicate what nominal ink quantity of the M different nominal ink quantities should be ejected by the respective nozzle 21, 22.

In an exemplary embodiment, based on the print data, the controller 101 can be configured to the select a first ejection pulse 401 of the M different first ejection pulses 401 to activate the first nozzle 21. Furthermore, based on the print data, the controller 101 can then select a second ejection pulse 402 of the M different second ejection pulses 402 to activate the second nozzle 22. Corduroy effects may thus be reduced in the printing of print data-based print images.

Exemplary embodiments of the present disclosure enable a system-dependent streaking of a printing system 100 to be at least partially compensated given a low computing power in the rastering process. In one or more embodiments, a hard-set compensation or a pre-established offset may thereby be used so that no additional calculation costs arise during a running printing process. Furthermore, the use of redundant print heads 103 to reduce the streaking may be omitted.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, "processor circuitry" can include one or more circuits, one or more processors, logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21 first nozzle
22 second nozzle
31 first column
32 second column
41, 42 nozzle rows
100 printing system
101 controller of the printing system 100
102 print bar
103 print head
201 nozzle opening
202 wall
210 meniscus
212 chamber
220 actuator (piezoelectric element)
221, 222, 322 deflection of the actuator
230 ink supply channel
300 print image
301, 302 groups of columns of nozzles
400 image point
401, 402 ejection pulses
410 activation point in time for printing a row
500 method for reducing a system-dependent streaking
501, 502 method operations

What is claimed is:

1. An inkjet printing system to reduce system-dependent streaking, comprising:

a print head including:

a first nozzle configured to print image points of a first column of a print image onto a recording medium, and a second nozzle configured to print image points of a second column of the print image onto the recording medium; and a controller that is configured to:

activate the first nozzle with a first ejection pulse to print an image point with a nominal ink quantity, and activate the second nozzle with a second ejection pulse to print an image point with the nominal ink quantity, the first ejection pulse and the second ejection pulse being different, wherein:

the print head is configured such that a first column of a test print image is lighter than a second column of a test print image if the first nozzle and the second nozzle are activated with a standard pulse for printing image points with the nominal ink quantity, the first column of the test print image being printed by the first nozzle and the second column of the test print image being printed by the second nozzle; and the first ejection pulse is stronger than the second ejection pulse.

2. The inkjet printing system according to claim 1, wherein:

the first ejection pulse is stronger than the standard pulse; and/or the standard pulse is stronger than the second ejection pulse.

3. The inkjet printing system according to claim 1, wherein the first ejection pulse and the second ejection pulse are configured such that a lightness difference between the first column and the second column of the test print image generated based on an activation of the first nozzle with the first ejection pulse and an activation of the second nozzle with the second ejection pulse is smaller than a lightness difference between the first column and the second column of the test print image generated based on an activation of both the first nozzle and the second nozzle with the standard pulse.

4. The inkjet printing system according to claim 1, wherein:

the print head comprises a plurality of nozzles configured to print a corresponding plurality of columns of a print image, the plurality of nozzles alternately including first groups and second groups of nozzles; and the controller is configured to:

activate the first groups of nozzles of the plurality of nozzles with the first ejection pulse to eject the nominal ink quantity, and activate the second groups of nozzles of the plurality of nozzles with the second ejection pulse to eject the nominal ink quantity.

5. The inkjet printing system according to claim 4, wherein the first groups of nozzles of the plurality of nozzles print lighter image points in a test print image than the second groups of nozzles of the plurality of nozzles in response to activations of both the first groups and the second groups of nozzles with a standard pulse.

6. The inkjet printing system according to claim 4, wherein the first groups of nozzles and/or the second groups of nozzles of the plurality of nozzles respectively comprise at least 4 or 8 nozzles.

7. The inkjet printing system according to claim 4, wherein the first groups of nozzles and/or the second groups of nozzles of the plurality of nozzles respectively comprise multiple nozzles configured to print image points of multiple directly adjacent columns.

8. The inkjet printing system according to claim 4, wherein activations using the first and the second ejection pulses reduces one or more deviations of quantities of ink ejected between the first groups of nozzles and the second groups of nozzles of the plurality of nozzles.

9. The inkjet printing system according to claim 8, wherein crosstalk between at least some of the plurality of nozzles of the print head generates the one or more deviations of ejected quantities of ink.

10. The inkjet printing system according to claim 1, wherein the controller is configured to:

activate the first nozzle to print different image points with M different nominal ink quantities based on accordingly M different first ejection pulses; wherein M is a whole number and M>1; and activate the second nozzle to print different image points with the M different nominal ink quantities based on accordingly M different second ejection pulses.

11. The inkjet printing system according to claim 10, wherein the controller is configured to:

determine print data to print a row of the print image, the print data for the first nozzle and for the second nozzle indicating whether one of the respective first and second nozzles is to eject ink to print an image point in the row of the print image, and indicating which nominal ink quantity of the M different nominal ink quantities is to be ejected by the one of the respective first and second nozzles;

select, based on the print data, a first ejection pulse of the M different first ejection pulses to activate the first nozzle of the plurality of nozzles; and select, based on the print data, a second ejection pulse of the M different second ejection pulses to activate the second nozzle of the plurality of nozzles.

12. The inkjet printing system according to claim 1, wherein the first ejection pulse is stronger than the second ejection pulse.

13. A method to reduce a system-dependent streaking of a print image printed by an inkjet printing system including a print head having a first nozzle to print image points in a first column of the print image, and having a second nozzle to print image points in a second column of the print image, the method comprising:

determining that the first nozzle and the second nozzle are to respectively eject ink with a nominal ink quantity to print image points in a specific row;

activating the first nozzle to print an image point of the specific row using a first ejection pulse, the activating the first nozzle to print the image point including activating the first nozzle to print different image points with M different nominal ink quantities based on M different of the first ejection pulses; wherein M is a whole number and M>1; and activating the second nozzle to print an image point of the specific row using a second ejection pulse, the first ejection pulse and the second ejection pulse being different, wherein the activating the second nozzle to print the image point includes activating the second nozzle to print different image points with the M different nominal ink quantities based on accordingly M different second ejection pulses.

14. The method according to claim 13, wherein the first ejection pulse is stronger than the second ejection pulse.

15. A non-transitory computer-readable storage medium with an executable program stored thereon, wherein, when executed, the program instructs a processor to perform the method of claim 13.

16. An inkjet printing system to reduce system-dependent streaking, comprising:

a print head including:

a plurality of nozzles that are configured to print a corresponding plurality of columns of a print image, the plurality of nozzles alternately including first groups and second groups of nozzles; and a controller that is configured to:

activate the first groups of nozzles of the plurality of nozzles with the first ejection pulse to eject the nominal ink quantity, and activate the second groups of nozzles of the plurality of nozzles with the second ejection pulse to eject the nominal ink quantity, the first ejection pulse and the second ejection pulse being different, wherein the first groups of nozzles of the plurality of nozzles print lighter image points in a test print image than the second groups of nozzles of the plurality of nozzles in response to activations of both the first groups and the second groups of nozzles with a standard pulse.

17. An inkjet printing system to reduce system-dependent streaking, comprising:

a print head including:

a plurality of nozzles that are configured to print a corresponding plurality of columns of a print image, the plurality of nozzles alternately including first groups and second groups of nozzles; and a controller that is configured to:

activate the first groups of nozzles of the plurality of nozzles with the first ejection pulse to eject the nominal ink quantity, and activate the second groups of nozzles of the plurality of nozzles with the second ejection pulse to eject the nominal ink quantity, the first ejection pulse and the second ejection pulse being different, wherein activations using the first and the second ejection pulses reduces one or more deviations of quantities of ink ejected between the first groups of nozzles and the second groups of nozzles of the plurality of nozzles.

* * * * *